US008814668B1

(12) United States Patent
Cornett

(10) Patent No.: US 8,814,668 B1
(45) Date of Patent: Aug. 26, 2014

(54) PARI-MUTUEL WAGERING SYSTEM AND METHOD

(75) Inventor: Mark A. Cornett, Naples, FL (US)

(73) Assignee: Pari-Mutual Solutions, LLC, Wilmington, DE (US)

( * ) Notice: Subject to any disclaimer, the term of this patent is extended or adjusted under 35 U.S.C. 154(b) by 141 days.

(21) Appl. No.: 12/880,775

(22) Filed: Sep. 13, 2010

Related U.S. Application Data

(60) Provisional application No. 61/242,173, filed on Sep. 14, 2009.

(51) Int. Cl.
*G07F 17/32* (2006.01)

(52) U.S. Cl.
USPC ..... 463/28; 463/26; 463/27

(58) Field of Classification Search
CPC . G07F 17/32; G07F 17/3262; G07F 17/3267; G07F 17/3288
USPC ..... 463/26–28
See application file for complete search history.

(56) References Cited

U.S. PATENT DOCUMENTS 4,874,177 A * 10/1989 Girardin ..... 273/246
5,275,400 A * 1/1994 Weingardt et al. ..... 463/12
6,126,543 A * 10/2000 Friedman ..... 463/16
6,926,607 B2 * 8/2005 Slomiany et al. ..... 463/20
7,094,151 B2 8/2006 Downes
7,713,125 B2 * 5/2010 Asher et al. ..... 463/28
7,997,981 B2 * 8/2011 Rowe et al. ..... 463/27
2001/0047291 A1 * 11/2001 Garahi et al. ..... 705/10
2004/0048656 A1 * 3/2004 Krynicky ..... 463/25
2005/0107153 A1 * 5/2005 Jubinville et al. ..... 463/18
2005/0124410 A1 * 6/2005 Vlazny et al. ..... 463/28
2005/0176499 A1 * 8/2005 Stronach ..... 463/27
2007/0026939 A1 * 2/2007 Asher et al. ..... 463/28
2007/0184890 A1 * 8/2007 Ollington ..... 463/17
2007/0270202 A1 * 11/2007 Vostoris ..... 463/16
2008/0076544 A1 * 3/2008 Mindes et al. ..... 463/28

* cited by examiner

*Primary Examiner* — Dmitry Suhol
*Assistant Examiner* — David Duffy
(74) *Attorney, Agent, or Firm* — Dinsmore & Shohl, LLP

(57) ABSTRACT

A pari-mutuel wagering system has a gaming computer, a wager database, an account database, and a wager receiving program operably installed in the memory of the gaming computer. The wager receiving program defines a first group of sporting events, and a second group of the sporting events. Wagers are made on who will win each of the sporting events in the first and second groups, and a primary pool of the wagers is allocated to a first common pari-mutuel fund, a second common pari-mutuel fund, and to a house commission. Winning wagers regarding the first group receive a payout according to a pari-mutuel strategy from the first common pari-mutuel fund, and are also eligible to win the second common pari-mutuel fund if they make winning wagers regarding the second group.

13 Claims, 3 Drawing Sheets

PARI-MUTUEL WAGERING SYSTEM AND METHOD

CROSS-REFERENCE TO RELATED APPLICATIONS

This application for a utility patent claims the benefit of U.S. Provisional Application No. 61/242,173, filed Sep. 14, 2009.

BACKGROUND OF THE INVENTION

1. Field of the Invention

This invention relates generally to wagering systems, and more particularly to a pari-mutuel wagering system wherein a primary pool of wagers is split into two pari-mutuel funds that are paid as a result of two different sets of wagering options.

2. Description of Related Art

Various forms of "sweep" wagers are known in the art, in which bettors select the winners of four or more successive races. In the United States, the "Pick 4" and "Pick 6" wagers are popular. While "consolation" payouts may be made for mostly correct picks (5 of 6 in the Pick 6), many of the jackpots rollover to future days in the event that nobody wins on a given day. While the large jackpots can be attractive, betters often perceive this as a difficult bet to win, because picking 6 winners in a row (or even 5, for a consolation prize) is difficult.

There are many other betting options that have much higher chances of success; however, these higher odds bets pay much lower amounts, and are therefore not as thrilling.

There is a long-felt need in the field for a wagering system that includes a first chance of winning with attractive odds of winning an initial payout, and also includes a second chance of winning in a "bonus" pool with a potentially much higher payout amount.

The prior art teaches pari-mutuel wagering; however, the prior art does not teach splitting a pari-mutuel pool into a first pari-mutuel betting pool that may be won by selecting winners in a first group of races, and a second pari-mutuel betting pool that may be won by selecting winners in a second, "bonus" group of races. The present invention fulfills these needs and provides further related advantages as described in the following summary.

SUMMARY OF THE INVENTION

The present invention teaches certain benefits in construction and use which give rise to the objectives described below.

The present invention provides a pari-mutuel wagering system and method for receiving a plurality of wagers on a plurality of sporting events. The pari-mutuel wagering system comprises a gaming computer having a processor and a memory; a wager database operably installed in the memory of the gaming computer; an account database operably installed in the memory of the gaming computer; and a wager receiving program operably installed in the memory of the gaming computer. The wager receiving program performs the following steps: defining a first group of the plurality of sporting events, and a second group of the plurality of sporting events; offering a first plurality of wagering options on the first group, a second plurality of wagering options on the second group; receiving the plurality of wagers regarding the plurality of sporting events, and storing the plurality of wagers in the wager database. A payment program operably installed in the memory of the gaming computer receives payments for each of the plurality of wagers, and stores the payments in the account database. A pool calculation program operably installed in the memory of the gaming computer performs the following steps: allocating the payments received via the payment program to a first common pari-mutuel fund corresponding the first plurality of wagering options, to a second common pari-mutuel fund corresponding to the second plurality of wagering options, and to a house commission; determining if there are any winning wagers of the first group; if there is at least one winning wager in the first group, determining a payout for each winning wager according to a pari-mutuel strategy from the first common pari-mutuel fund, and if there are no winners, maintaining the funds in the first common pari-mutuel fund for payout in future sporting events; if there is at least one winning wager in the first group, determining if there are any winning wagers in the second group; and if at least one of the plurality of wagers is a winner in both the first group and the second group, determining a payout for each of these winning wagers according to a pari-mutuel strategy from the second common pari-mutuel fund, and if none of the plurality of wagers is a winner in both the first group and the second group, maintaining the funds in the second common pari-mutuel fund for payout in future sporting events.

A primary objective of the present invention is to provide a pari-mutuel wagering system and method having advantages not taught by the prior art.

Another objective is to provide a pari-mutuel wagering system and method of splitting a pari-mutuel pool into a first pari-mutuel betting pool that may be won by selecting winners in a first group of races, and a second pari-mutuel betting pool that may be won by selecting winners in a second, "bonus" group of races.

A further objective is to provide a pari-mutuel wagering system and method that enables Other features and advantages of the present invention will become apparent from the following more detailed description, taken in conjunction with the accompanying drawings, which illustrate, by way of example, the principles of the invention.

BRIEF DESCRIPTION OF THE DRAWING

The accompanying drawings illustrate the present invention. In such drawings.

DETAILED DESCRIPTION OF THE INVENTION

The above-described drawing figures illustrate the invention, a pari-mutuel wagering system 10 for facilitating pari-mutuel wagering on sporting events such as horse-races, or similar events in which bettors might want to wager on the outcome of the event.

Figure 1:
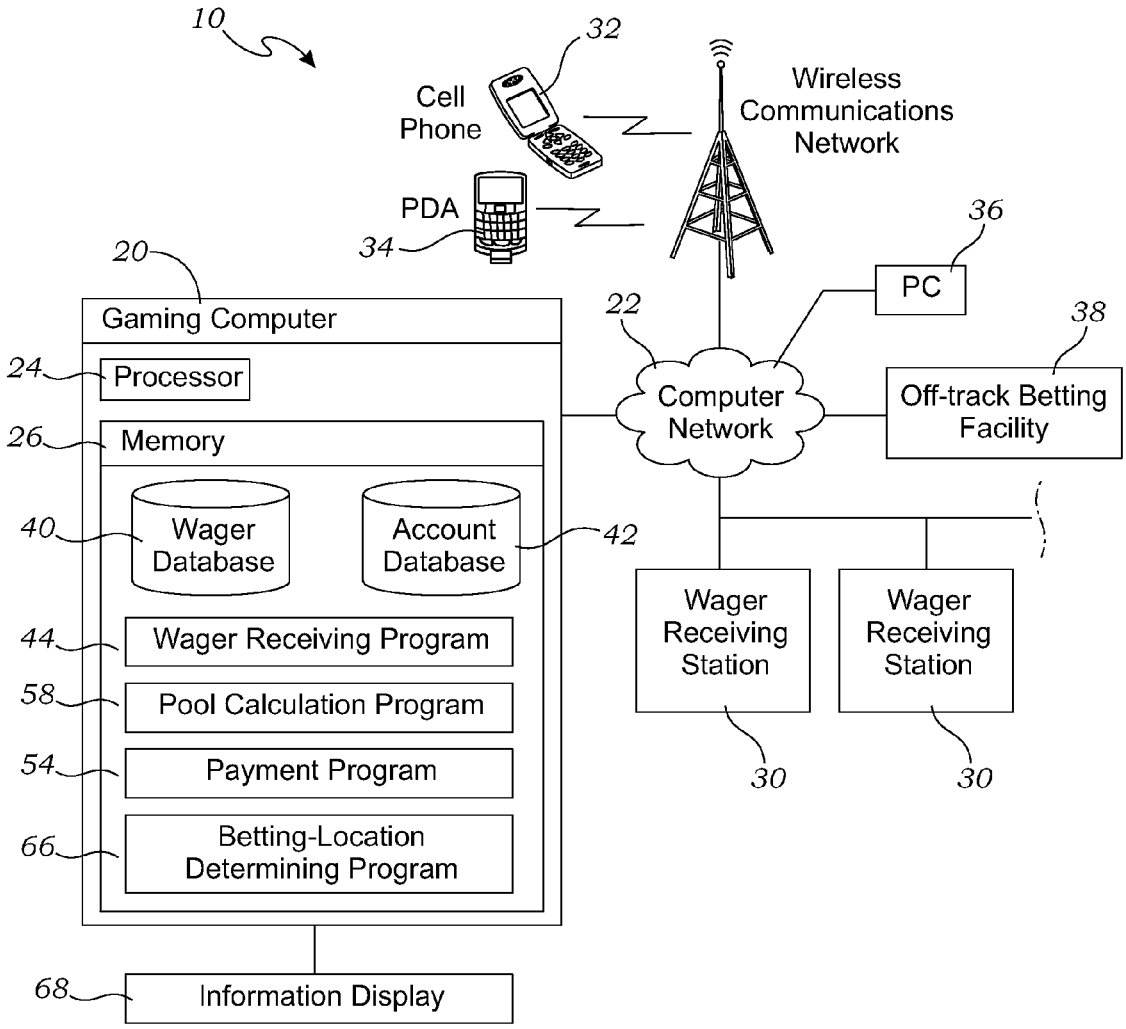
FIG. 1 is a block diagram of a pari-mutuel wagering system according to one embodiment of the present invention, the system including a gaming computer having a pool calculation program.

FIG. 1 is a block diagram of one embodiment of the pari-mutuel wagering system 10. As illustrated in FIG. 1, in one embodiment the pari-mutuel wagering system 10 may be executed on a gaming computer 20 that is adapted for receiving a plurality of wagers on the sporting events. The gaming computer 20 may be operably connected to a computer network 22 for transacting business via a network of parties, such as via the Internet; in an alternative embodiment, however, it may be a single computer system operated at a single location.

The gaming computer 20 includes a processor 24, and a memory 26 (some form of computer readable media, e.g., hard drive, or similar data storage device) for storing programs, operating systems, and other elements necessary for the function of the pari-mutuel wagering system 10. The gaming computer 20 need not be a single piece of equipment, but may comprise a combination of disparate devices that operate together to perform the described functions. The gaming computer 20 is programmed to track betters, and accept and process wagers, and pay payouts to winners. The gaming computer 20 may also function to register individual bettors, create individual accounts, and handle wagering via the Internet, as discussed in greater detail below.

A bettor may access, interface with and place bets on the pari-mutuel wagering system 10 by use of a wager receiving station 30, or at a location of the sporting events (e.g., at the track) using betting systems already known in the art. In one embodiment, the wager receiving station 30 may be a computer system or kiosk provided at the racetrack or other location for the purpose of receiving wagers, either in person or via an employee at the track, casino, etc. For purposes of this specification, however, the term "wager receiving station" is hereby defined to include alternative systems and methods for receiving wagers. For example, various communications devices, such as cell phones 32, PDAs 34, offtrack betting facilities 38, and other means known in the art, may be used to access the gaming computer 20 (or associated computer or communications device) for the purposes of placing wagers. A wireless communications network or similar network may be used to connect the wireless devices and the wagering system 10. Furthermore, a personal computer ("PC") 36 of any person who has access to the Internet may also be adapted to function as the wager receiving station 30, with proper software using techniques well known in the art (e.g., using a browser). All of these alternatives should be considered within the scope of the term "wager receiving station."

The gaming computer 20 is the core processing element in the pari-mutuel wagering system 10, handling wagering gaming and bettor accounting functions. The gaming computer 20 handles the processing functions associated with bettors' wagering accounts. Such functions may include game accounting, wager accounting, odds determination, winning wager determination, payout determination, system security, access permission and performance statistics accounting. The gaming computer 20 may be a single server, device, or a combination of devices that collectively perform the functions described. The wagering system host's processing ability can be scaled in order to meet bettor demand with respect to the described functions. In addition, the wagering system host's processing ability can be scaled in order to meet bettor demand with respect to a particular game or demand with respect to new games.

The pari-mutuel wagering system 10 includes a wager database 40 operably installed in the memory 26 of the gaming computer 20, an account database 42 operably installed in the memory 26 of the gaming computer 20, and other databases and similar programs for tracking the various data associated with the function of the pari-mutuel wagering system 10. The wager database 40 functions for tracking wagers made on a specific event (e.g., series of horse-races), and the account database 42 functions for tracking the financial accounts of the house and various participants. These databases may be maintained in a single program on a single computer device, or in multiple programs maintained on one or multiple computer devices, as is well known in the art, and the term "database" is hereby defined to include any such configuration of data collection and storage.

The wager database 40 stores information regarding current (and potentially also past) sporting events, such as horses races. The wager database 40 may include bettor name and related information (e.g., phone number, email address, and other contact information). The wager database 40 may also include, amounts wagered, wager results, wager payouts, and similar information. The account database 42 is linked to, and functions in conjunction with, the gaming computer 20. The account database 42 stores information regarding individual bettor accounts. The information stored includes financial transaction history, wager history, payout history, financial withholding information, financial reporting information and current wagers. Obviously a wide range of information may be included with or linked to these databases, and such alternatives are considered within the scope of the present invention.

The pari-mutuel wagering system 10 includes a wager receiving program 44 operably installed in the memory 26 of the gaming computer 20 for interacting with the wager receiving station 30 for receiving wagers. The wager receiving program 44 defines a first group of the plurality of sporting events, and a second group of the plurality of sporting events. For example, a racetrack may use the wager receiving program 44 to define a first set of races (e.g., the first four races), and a second set of races (e.g., races five and six), although obviously the number of races, and the specific races selected, may vary.

Figure 2:
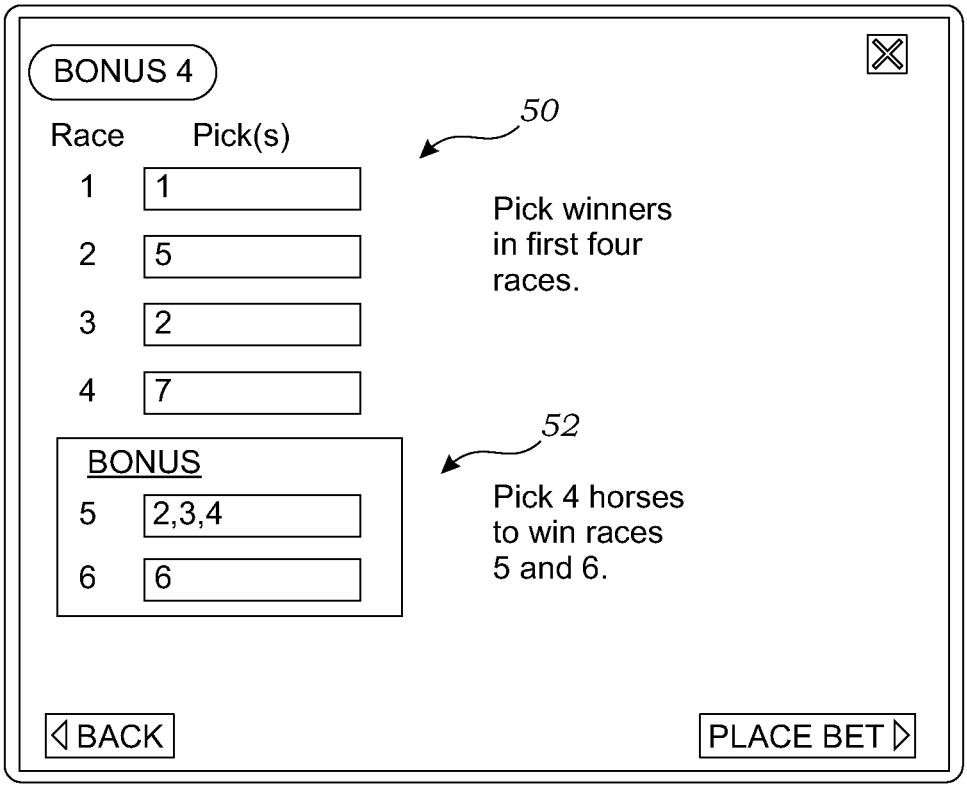
FIG. 2 is a screen image that illustrates one embodiment of a wager receiving form generated from the pool calculation program for receiving a wager.

The wager receiving program 44 then offers a first plurality of wagering options 50 on the first group, and a second plurality of wagering options 52 on the second group. The first and second plurality of wagering options 50 are illustrated in FIG. 2. The wager receiving program 44 of FIG. 1 then functions to receive the plurality of wagers regarding the plurality of sporting events, and storing the plurality of wagers in the wager database 40. In the example of the racetrack, the first and second plurality of wagering options 50 and 52 may include selecting a winner in each race. In the present embodiment, the second plurality of wagering options 52 includes selecting four horses, in the two races, to win the races.

As illustrated in FIG. 1, a payment program 54 is operably installed in the memory 26 of the gaming computer 20 to receive payments for each of the plurality of wagers, and to store the payments in a primary pool 56 (illustrated in FIG. 3) tracked by the account database 42 of FIG. 1. In the embodiment of FIG. 1, the payment program 54 may include an electronic payment system that is adapted to handle electronic payments, transfers of funds, and similar transactions associated with the operation of the wagering game to include, but not limited to, wire transfers, electronic funds transfer, credit cards, debit cards, smart cards, PAYPAL®, and any other methods of payment known in the art. In addition, the electronic payment program 54 of the pari-mutuel wagering system 10 may further include a manual capability in order to allow manual handling of financial transactions associated with the operation of the wagering game (e.g., cash, checks, money orders, traveler's checks, etc.). Some of the manual handling may include wagering processing tasks performed by racetrack personnel, using systems already established for receiving wagers.

Figure 3:
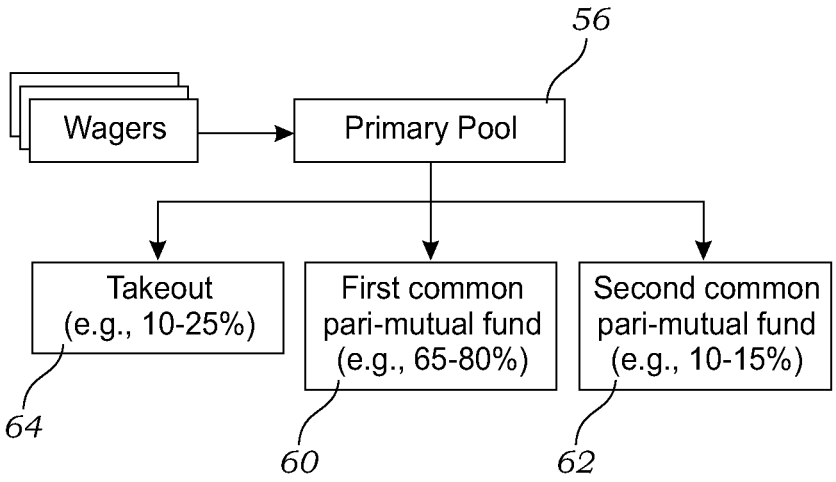
FIG. 3 is a flow diagram of the operation of the pool calculation program for dividing a primary pool of wagers between a house commission, and first and second common pari-mutuel funds.

As illustrated in FIG. 1, a pool calculation program 58 is operably installed in the memory 26 of the gaming computer 20. The pool calculation program 58 functions to distribute the wagers according to the unique pari-mutuel strategy discussed in greater detail below, and illustrated in FIGS. 3-4. As illustrated in FIG. 3, the pool calculation program 58 first allocates the funds in the primary pool 56, from the payments received via the payment program 54, to a first common pari-mutuel fund 60 corresponding the first plurality of wagering options 50, to a second common pari-mutuel fund 62 corresponding to the second plurality of wagering options 52, and to a house commission 64 or "take."

Figure 4:
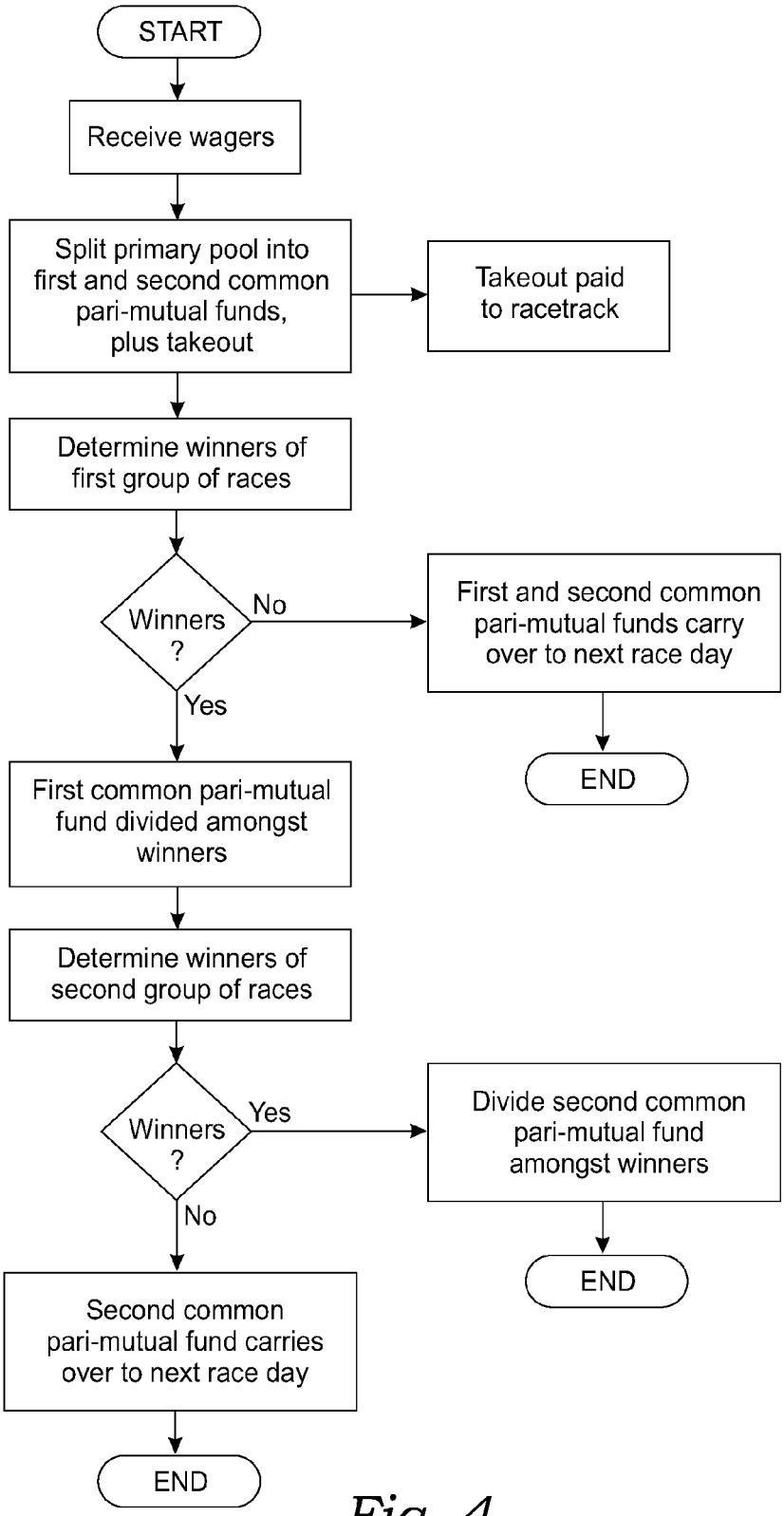
FIG. 4 is a flow diagram of the operation of the pool calculation program for determining payments to be made to winners.

As illustrated in FIG. 4, the pool calculation program 58 then determines if there are any winning wagers of the first group of sporting events (e.g., horse races). If there is at least one winning wager in the first group, a payout is determined for each winning wager according to a pari-mutuel strategy from the first common pari-mutuel fund. 60 Typically, the pari-mutuel strategy includes dividing the first common pari-mutuel fund 60 evenly between the winning bettors; however, this strategy can also include partial payments of "consolation" prizes for partially correct wagers. These consolation winners may or may not be considered "winners" for purposes of payments from the second common pari-mutuel fund 62, as discussed in greater detail below. If there are no winners, the first and second common pari-mutuel funds 60 and 62 are maintained for payout in future events (i.e., "carry over").

If there is at least one winning wager in the first group, it is then determined if there are any winning wagers in the second group. If at least one of the plurality of wagers is a winner in both the first group and the second group, a payout is determined for each of these winning wagers according to a pari-mutuel strategy from the second common pari-mutuel fund 62. If none of the plurality of wagers is a winner in both the first group and the second group, the funds in the second common pari-mutuel fund 62 are maintained for payout in future events.

As wagers are being placed, information about the existing wagers may be displayed upon an information display (e.g., computer monitor, etc.) so that other betters can determine odds and see the potential payoffs for various bets. Results may also be posted, using techniques known in the art.

The gaming computer 20 of FIG. 1 may further include a bettor-location determining program 66 operably installed in the memory 26 of the gaming computer 20. The bettor-location determining program 66 functions to determine the physical location of the bettor, using techniques known in the art, and may be configured to allow or disallow access to wagering functionality based on bettor location, allowing wagering activity only in proper and legally permissible locations. An operator may have the ability to select, remove and modify the locations where access to gaming functionality is allowed.

FIG. 2 is a screen image that illustrates one embodiment of a wager receiving form 68 generated by the pool calculation program 58 of FIG. 1. The wager receiving form 68 is adapted to receive wagers from betters. The wager receiving form 68 may be generated by the pool calculation program 58 in one embodiment of the invention, and delivered to a computer display for completion, either by the bettor directly, or by race-track employees. Furthermore, the wager receiving form 68 may be electronically generated via computer, or similarly may be printed for manual completion and entry.

In the embodiment of FIG. 2, the participant is enabled to select at least one horse in each of four races. The races may be consecutive races at one particular location, or they may be particularly selected races, at one or more physical locations. For purposes of clarity, we will discuss a particular situation, illustrated in FIG. 2, wherein the participant selects one horse in each race for a single entry fee (e.g., $2). Obviously, additional selections may be made if higher entry fees are paid. For example, of 2 horses are selected in Race 1 and one horse in all the others, the entry fee would be $4. If 3 horses are selected in Race 1, and two in race 2, and one in the rest, this would cost $12.

The better then also selects a group of horses for a second group of races. For example, in the present embodiment, the user selects four horses from the $5^{th}$ and $6^{th}$ races. These four horses may be selected from either race, so the user might select two horses in each race, or one horse in one race, and three horses in the other race. In the illustrated embodiment, the user selects horses 2, 3, and 4 in the $5^{th}$ race, and horse 6 in race 6. Obviously, the number of horses selected, and the number of races involved, may vary depending upon the needs of the venue, system, or operator.

FIG. 3 is a flow diagram of the operation of the pool calculation program 58 for dividing the primary pool 56 of wagers to the takeout and to the first and second common pari-mutuel funds 60 and 62. As illustrated in FIG. 3, and as discussed above, the wagers are taken from the bettors to create the primary pool 56. The house commission, or "take-out" (or "take") is removed from the primary pool 56, and is paid as commission to an operator of the system, racetracks, and/or other operators. A first portion of the primary pool 56 of wagers is allocated as a first common pari-mutuel fund 60 for paying winning wagers in the first set of races (i.e., selecting the winners of the first four races, although the number of races may vary). A second portion of the primary pool 56 of wagers as a second common pari-mutuel fund 62 for providing a bonus pool for winners of the second set of races. It is important to the invention that the common pool be split into these two different pari-mutuel funds, for providing different benefits to bettors.

In one embodiment, the pool of all wagers made is distributed as follows: the takeout 64 is 10-25%, the first common pari-mutuel fund 60 is 65-80%, and the second common pari-mutuel fund 62 is 10-15%. Obviously, these ranges may be modified by those skilled in the art of gaming to suit the needs of a given race track, or other gaming facility.

FIG. 4 is a flow diagram of the operation of the pool calculation program 58 for determining winners and payments to be made to the winners. As illustrated in FIG. 4, the pool calculation program 58 may be used to determine if there are any winning wagers of the first group of sporting events (e.g., horse races). If there is at least one winning wager in the first group, a payout is determined for each winning wager according to a pari-mutuel strategy from the first common pari-mutuel fund 60. Typically, the first common pari-mutuel fund 60 is divided evenly between the winning bettors. If there are no winners, the first and second common pari-mutuel funds 60 and 62 are maintained for payout in future events (i.e., "carry over"). As discussed above, consolation prizes may be offered for picking most of the winners (in this case, three of four).

As discussed above, in one embodiment the pari-mutuel wagering system 10 is used for the selection of winning horses in multiple horse races. For example, selecting the winners in four races is illustrated in FIG. 2; however, alternative systems may be used. For example, selections may also be made of first place, second place, and/or third place horses (or even of losing horses, if desired). Any range of multiple horse races may be used., as long as the odds are difficult enough to significantly restrict the pool of winners.

If there is at least one winning wager in the first group, it is then determined if there are any winning wagers in the second group. If at least one of the plurality of wagers is a winner in both the first group and the second group, a payout is determined for each of these winning wagers according to a pari-mutuel strategy from the second common pari-mutuel fund 62. If none of the plurality of wagers is a winner in both the first group and the second group, the funds in the second common pari-mutuel fund 62 are maintained for payout in future events.

In the determination, if there is no winner in the first part, the first and second common pari-mutuel funds 60 and 62 are held over until the next designated races. If there is a winner in the first portion, and at least one better selects all four winning horses, this first common pari-mutuel fund 60 is paid to the winner (or split among multiple winners). Furthermore, these winners then proceed to the second part, and it is determined if any of these winners selected the winners in the second part of the contest (selecting the winners in races 5 and 6, in this case).

It is also possible that one of the bettors may win a consolation prize of some sort for picking most of the winners (in this case, picking three of the four winners). These consolation winners may or may not be defined as "winners," both for purposes of receiving a full or partial payment from the first common pari-mutuel fund 60, and for potentially gaining access to the second common pari-mutuel fund 62 of the bonus races. Even if some of the consolation winners may not receive any payment from the first common pari-mutuel fund 60, they may still advance to the second bonus round, and may even end up winning the second common pari-mutuel fund 62. In this manner, some bettors that don't get paid from the first common pari-mutuel fund 60 may still hope to win a large payout from the second common pari-mutuel fund 62.

If there are winners of the second plurality of wagering options 52, then these winners split the second common pari-mutuel fund 62, along with any hold over from previous races. If there is no winner, then the second common pari-mutuel fund 62 is held over for payout in future races. It is also possible that there could be a form of consolation winner in the second fund 62; however, in the preferred embodiment this is maintained as a much larger "jackpot" to entice future betting.

This system 10 provides many benefits to participants. First, all of the winning participants in the first portion of the wager win a portion of the first fund 60. This is appealing to the participants because they stand a reasonable chance of winning the first portion of the wager and winning at least some money. Second, the select group who win in the first portion then also participate in the special extra pool, with a chance of winning an extra payout. If there are no winners of the special extra pool, the funds carry over to future racing events, so there is a chance of an especially large and exciting jackpot building up for future winners. By separating the primary pool 56 into two different pools, the first and second common pari-mutuel funds 60 and 62, betters are able to receive two benefits, both a reasonable chance of winning the first common pari-mutuel fund 60, and also a long shot of winning a much larger "jackpot" of the second common pari-mutuel fund 62.

In one embodiment, the method of pari-mutuel wagering is specifically adapted for horse races. A first group of at least three horse races is defined (e.g., the first three or four races), as is a second group of at least two horse races (e.g., the fifth and sixth races). The first plurality of wagering options 50 are defined, and offered on the first group (e.g., selecting the winning horse), and the second plurality of wagering options 52 is defined, and offered on the second group (e.g., selecting a group of horses which includes the winners of both races). As discussed above, the first and second wagering options 50 and 52 may be offered via web page, as illustrated in FIG. 2, or via any other methods discussed above.

The wagers are received regarding the first and second plurality of wagering options 50 and 52, and payments are received for each of the plurality of wagers. The payments into the primary pool 56 are allocated to the first and second common pari-mutuel funds 60 and 62, as discussed above, and to the house commission 64.

Following the races, it is determined if there are any winning wagers placed on the first group. If there is at least one winning wager placed on the first group, a payout is determined for each winning wager according to a pari-mutuel strategy from the first common pari-mutuel fund 60. For example, if there are two winners, the first common pari-mutuel fund 60 is split between the two winners (along with any carryover, if any, from previous races). If there are no such winning wagers, the first common pari-mutuel fund 60 is carried over to the next racing day.

If there is at least one winning wager in the first group, it must be determined if there are any winning wagers in the second group. If at least one of the plurality of wagers is a winner in both the first group and the second group, a payout is determined for each of these winning wagers according to a pari-mutuel strategy from the second common pari-mutuel fund 62. For example, if there is one winner, he or she would receive the entire second common pari-mutuel fund 62, plus any carryover from previous races. If none of the plurality of wagers is a winner in both the first group and the second group, the second common pari-mutuel fund 62 is retained for future race days.

In the preferred embodiment, the system and method are implemented on one or more computer systems and/or networks. Particularly, the system and method may be implemented using software, hardware, firmware or any combination thereof, as would be apparent to those of ordinary skill in the art, and the figures and examples below are not meant to limit the scope of the present invention. Moreover, where certain elements of the present invention can be partially or fully implemented using known components and processes, only those portions of such known components and processes that are necessary for an understanding of the present invention will be described, and detailed descriptions of other portions will be omitted so as not to obscure the invention.

The gaming computer 20 (and/or any other computer or computer device) may be a standard server, or personal computer platform, having a standard construction known to those skilled in the art. In alternative embodiments, however, the terms computer, processor, memory 26, and other computer related components, are hereby expressly defined to include any arrangement of computer(s), processors, memory devices, and/or computer components, either as a single unit or operably connected and/or networked across multiple computers (or distributed computer components), to perform the functions described herein.

As used in this application, the words "a," "an," and "one" are defined to include one or more of the referenced item unless specifically stated otherwise. Also, the terms "have," "include," "contain," and similar terms are defined to mean "comprising" unless specifically stated otherwise. Furthermore, the terminology used in the specification provided above is hereby defined to include similar and/or equivalent terms, and/or alternative embodiments that would be considered obvious to one skilled in the art given the teachings of the present patent application.

What is claimed is:

1. A system for receiving a wager on sporting events, system comprising:

a gaming computer having a processor and a memory, the memory storing a program that, when executed by the gaming computer, causes the gaming computer to perform at least the following:

offer first wagering options on a first group of sporting events and second wagering options on a second group of sporting events;

provide a user interface for receiving user bets regarding the first group of sporting events and the second group of sporting events;

receive, via the user interface, a wager on the first group of sporting events and the second group of sporting events, wherein the wager includes a selected outcome of at least two of the sporting events in the first group of sporting events and at least two of the sporting events in the second group of sporting events;

receive a payment for the wager;

allocate a first portion of the payment to a first common pari-mutuel fund corresponding the first group of sporting events;

allocate a second portion of the payment to a second common pari-mutuel fund corresponding to the second group of sporting events;

determine whether the wager is a winning wager for the first group of sporting events;

in response to determining the wager is not a winning wager for the first group of sporting events, determine whether the wager won a subset of the first group of sporting events, and, in response to determining that the wager won a subset of the first group of sporting events, determine a consolation prize for the bettor, wherein the consolation prize includes no cash payout, but qualifies the bettor for potentially winning the portion of the wager on second group of sporting events;

in response to determining that the wager is a winning wager for the first group of sporting events, determining a first payout to the winning wager according to a pari-mutuel strategy from the first common pari-mutuel fund and determine whether the wager is a winning wager for the second group of sporting events; and in response to determining that the wager won the subset of the first group of sporting events or is a winning wager for the first group of sporting events and is a winning wager for the second group of sporting events, determine a second payout for the winning wager of the second group of sporting events according to the pari-mutuel strategy from the second common pari-mutuel fund, wherein the bettor qualifies for second payout only if the first wager wins the subset of sporting events or the wager is a winning wager for the first group of sporting events and the wager is a winning wager for the second group of sporting events.

2. The system of claim 1, wherein in response to determining that there are no winners of the first group of sporting events, the program causes the gaming computer to maintain the payment in the first common pari-mutuel fund for payout in a future sporting event.

3. The system of claim 1, wherein in response to determining that no winners of the first group of sporting events and the second group of sporting events, the program causes the gaming computer to maintain the payment in the second common pari-mutuel fund for payout in a future sporting event.

4. The system of claim 1, further comprising a wager database for storing the wager.

5. The system of claim 1, further comprising an account database for storing the payment.

6. A method for receiving wagers on sporting events, comprising:

offering, by a computing device, a single user interface that provides first wagering options on a first group of sporting events and second wagering options on a second group of sporting events;

receiving, by the computing device, a plurality of wagers, the plurality of wagers being placed on the first group of sporting events and the second group of sporting events respectively, wherein each of the plurality of wagers includes a selected outcome of at least two of the sporting events in the first group of sporting events and at least two of the sporting events in the second group of sporting events;

determining, by the computing device, whether any of the plurality of wagers is a winning wager for the first group of sporting events;

in response to determining that a portion of the plurality of wagers directed to the first group of sporting events is not a winning wager for the first group of sporting events, determining whether the portion directed to the first group of sporting events won a subset of the first group of sporting events, and, in response to determining that the portion directed to the first group of sporting events won a subset of the first group of sporting events, determining a consolation prize for the bettor, wherein the consolation prize includes no cash payout, but qualifies the bettor for potentially winning the wager on second group of sporting events;

in response to determining that at least one of the plurality of wagers is a winning wager for the first group of sporting events, determining, by the computing device, a first payout to the winning wager and determining whether the at least one of the plurality of wagers is a winning wager for the second group of sporting events; and in response to determining that the portion directed to the first group of sporting events won a subset of the first group of sporting events or is a wining wager for the first group of sporting events and is a winning wager for the second group of sporting events, determining, by the computing device, a second payout for the winning wager of the second group of sporting events, wherein the bettor qualifies for second payout only if the portion directed to the first group of sporting events wins the subset of sporting events or the portion directed to the first group of sporting events is a winning wager for the first group of sporting events and the at least one of the wagers is a winning wager for the second group of sporting events.

7. The method of claim 6, further comprising:

receiving payment for each of the plurality of wagers in a single transaction;

allocating a first portion of the payment for each of the plurality of wagers to a first common pari-mutuel fund corresponding the first group of sporting events; and determining a first payout of the winning wager from the first common pari-mutuel fund.

8. The method of claim 6, further comprising:

receiving payment for each of the plurality of wagers;

allocating a second portion of the payment for each of the plurality of wagers to a second common pari-mutuel fund corresponding to the second group of sporting events; and determining a second payout of the winning wager from the second common pari-mutuel fund.

9. The method of claim 6, wherein in response to determining that there are no winners of the first group of sporting events, maintain payment for each of the plurality of wagers for payout in a future sporting event.

10. The method of claim 6, wherein in response to determining that there are no winners of the first group of sporting events and the second group of sporting events, the maintain payment for each of the plurality of wagers for payout in a future sporting event.

11. A non-transitory computer-readable medium for receiving a wager on sporting events that stores a program that, when executed by a computing device, causes the computing device to perform at least the following:

offer a single user interface that provides first wagering options on a first group of sporting events and second wagering options on a second group of sporting events;

receive a wager on the first group of sporting events and the second group of sporting events, wherein the wager includes a selected outcome of at least two of the sporting events in the first group of sporting events and at least two of the sporting events in the second group of sporting events;

receive a payment for the wager;

allocate a first portion of the payment to a first common pari-mutuel fund corresponding the first group of sporting events;

allocate a second portion of the payment to a second common pari-mutuel fund corresponding to the second group of sporting events;

determine whether the wager is a winning wager for the first group of sporting events;

in response to determining the wager is not a winning wager for the first group of sporting events, determine whether the wager won a subset of the first group of sporting events, and, in response to determining that the wager won a subset of the first group of sporting events, determine a consolation prize for the bettor, wherein the consolation prize includes no cash payout, but qualifies the bettor for potentially winning the portion of the wager on second group of sporting events;

in response to determining that the wager is a winning wager for the first group of sporting events, determining a first payout to the winning wager according to a pari-mutuel strategy from the first common pari-mutuel fund and determine whether the wager is a winning wager for the second group of sporting events; and in response to determining that the wager is a winning wager for the first group of sporting events or the wager won a subset of the first group of sporting events and is a winning wager for the second group of sporting events, determine a second payout for the winning wager of the second group of sporting events according to the pari-mutuel strategy from the second common pari-mutuel fund, wherein the bettor qualifies for second payout only if the wager on the first group of sporting events wins the subset of sporting events or the wager on the first group of sporting events is a winning wager for the first group of sporting events and the wager is a winning wager for the second group of sporting events.

12. The non-transitory computer-readable medium of claim 11, wherein in response to determining that there are no winners of the first group of sporting events, the program causes the computing device to maintain the payment in the first common pari-mutuel fund for payout in a future sporting event.

13. The non-transitory computer-readable medium of claim 11, wherein in response to determining that there are no winners of the first group of sporting events and the second group of sporting events, the program causes the computing device to maintain the payment in the second common pari-mutuel fund for payout in a future sporting event.

* * * * *